United States Patent [19]

Tomisawa

[11] 4,407,461

[45] Oct. 4, 1983

[54] SPOOL HOLDING DEVICE

[76] Inventor: Susumu Tomisawa, 4–41–12 MaeKawa-cho, Kawaguchi-shi, Saitama-Ken, Japan

[21] Appl. No.: 351,891

[22] Filed: Feb. 24, 1982

[30] Foreign Application Priority Data

Mar. 23, 1981 [JP] Japan ..... 56-41061[U]

[51] Int. Cl.[3] ..... B65H 49/18

[52] U.S. Cl. ..... 242/134; 242/139

[58] Field of Search ..... 242/134, 139, 147 R, 242/157 R; 112/253–255, 302, 278; 66/125 R; 57/58.83, 352; 223/106; 225/38, 46

[56] References Cited

U.S. PATENT DOCUMENTS

| | | | |
|---|---|---|---|
| 1,690,367 | 11/1928 | Gotchette | 242/139 |
| 1,957,125 | 5/1934 | Zeier | 242/139 |
| 2,090,286 | 8/1937 | Chura | 242/139 |
| 2,940,685 | 6/1960 | Glass | 242/139 |
| 3,213,815 | 10/1965 | Rüssmann | 112/218 |
| 3,411,681 | 11/1968 | Bergman et al. | 225/38 |
| 3,987,978 | 10/1976 | Alberelli et al. | 242/134 |

*Primary Examiner*—Leonard D. Christian

*Attorney, Agent, or Firm*—Pearne, Gordon, Sessions, McCoy, Granger & Tilberry

[57] ABSTRACT

A spool holding device for a sewing machine in which a spool holder base is positioned above a rear portion of the sewing machine and supports a plurality of upper and lower thread spools thereon, a first thread guide plate is positioned above the spool holder base and has a plurality of spaced upper and lower thread guide holes, a second thread guide plate is supported on the arm of the sewing machine and has a plurality of upper thread guide holes and a thread retaining means is associated with said second thread guide plate for retaining a thread which is not used for sewing.

5 Claims, 4 Drawing Figures

FIG. 1
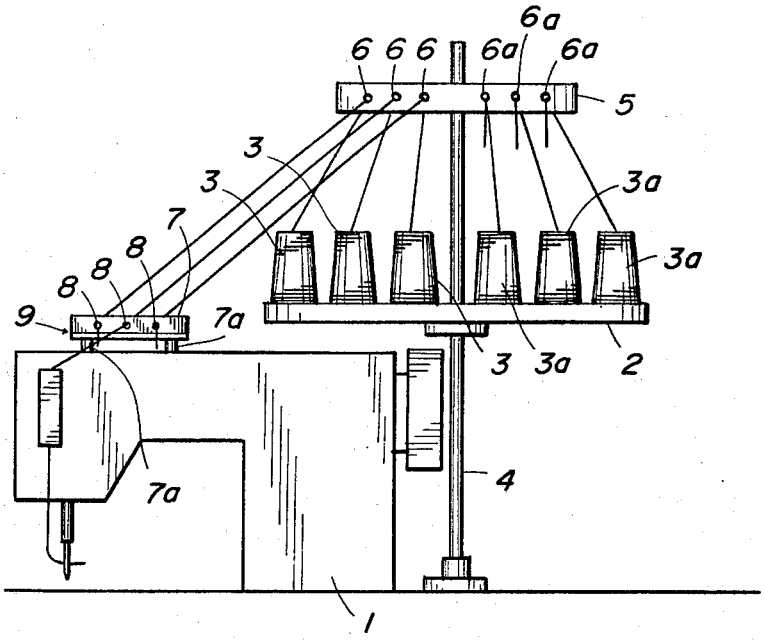
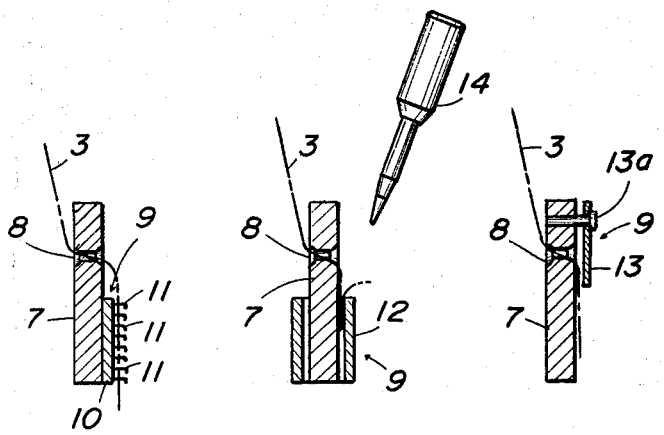
FIG. 2A FIG. 2B FIG. 2C

SPOOL HOLDING DEVICE

BACKGROUND OF THE INVENTION

This invention relates to a spool holding device which positions the leading end of a sewing machine thread in a predetermined position and more particularly, to a spool holding device which guides and arranges the leading ends of the threads from a plurality of spools in predetermined positions.

There have been proposed and practically employed a variety of spool holding devices for sewing machines. In the conventional spool holding devices, when a sewing machine thread being used for sewing is replaced by another sewing machine thread, the whole spool which is mounted on its spool pin and from which the first-mentioned sewing machine thread is payed out with the leading end thereof being guided in a predetermined path and passed through the sewing needle is removed from the spool pin and another spool is then mounted on the now vacant spool pin. However, of late, sewing machine threads of different colors and/or materials have been increasingly employed in one sewing operation and as a result, the thread replacement operation has to be quite frequently conducted in the one sewing operation. The replacement of a whole spool is a quite troublesome and time consuming operation.

SUMMARY OF THE INVENTION

Thus, the present invention is to eliminate the disadvantage inherent in the conventional spool holding devices.

The principal object of the present invention is to provide a novel and improved spool holding device which avoids the necessity of removal of a whole spool in the thread replacement.

The purpose of the present invention can be attained by the provision of a novel and improved spool holding device in which a plurality of spools are mounted on a spool holder base with the leading ends of the threads from the spools being positioned in predetermined positions in proper arrangement and when a thread replacement is conducted, only a portion of the thread which extends in the path of the thread down-stream of the predetermined position is removed.

According to the present invention, there has been provided a spool holding device for a sewing machine comprising a spool holder base positioned above a rear portion of said sewing machine and supporting a plurality of spaced upper thread spools on one half portion and a plurality of spaced lower thread spools on the other hald portion of said spool holder base, respectively, a first thread guide plate positioned above and extending in parallel to said spool holder base, said first thread guide plate being provided in one half portion of the plate with a plurality of spaced upper thread guide holes and in the other half portion of the plate with a plurality of spaced lower thread guide holes, a second thread guide plate supported on the top of the arm of said sewing machine and extending in parallel to said arm, said second thread guide plate being provided with a plurality of upper thread guide holes, and a thread retaining means associated with said second thread guide plate for retaining the thread payed out of one selected upper thread spool in cooperation with the second thread guide plate, whereby the leading ends of the threads payed out of the respective upper thread spools are passed through the respectively associated upper thread guide holes in the first and second thread guide plates and positioned above said arm of the sewing machine and the leading ends of the threads payed out of said lower threads spools are passed through the respectively associated lower thread guide holes in the said first thread guide plate to dangle from the guide plate.

The above and other objects and attendant advantages of the present invention will be more readily apparent to those skilled in the art from a reading of the following detailed description in conjunction with the accompanying drawing which shows one preferred embodiment of the present invention for illustration purpose only, but not for limiting the scope of the same in any way.

BRIEF DESCRIPTION OF THE DRAWINGS

FIG. 1 is a front elevational view of the preferred embodiment of the spool holding device constructed in accordance with the principle of the present invention; and FIGS. 2A, 2B and 2C are vertically sectional views on an enlarged scale of different thread retaining means for use with the spool holding device of the invention.

DESCRIPTION OF PREFERRED EMBODIMENT

The present invention will now be described referring to the accompanying drawing and more particularly, to FIG. 1 thereof in which one preferred embodiment of the spool holding device constructed in accordance with the present invention is shown in a front elevational view.

In FIG. 1, reference numeral 1 denotes the arm of a sewing machine and the arm 1 is not limited to any specific type. The sewing machine arm 1 may be that of a domestic or industrial sewing machine which is either for general sewing or embroidering purpose.

A horizontal spool holder base 2 is positioned above a rear portion of the sewing machine arm 1 and a plurality of spaced upper thread spools 3, 3, 3, . . . are supported on spool pins provided on the left-hand half portion of the spool holder base 2 and a plurality of spaced lower thread spools 3*a*, 3*a*, 3*a* are supported on spool pins provided on the right-hand half portion of the spool holder base 2, respectively (as seen in FIG. 1). Disposed above and parallel to the spool holder base 2 is a first horizontal thread guide plate 5 which is provided with a plurality of spaced upper thread guide holes 6, 6, 6, . . . in the left-hand half portion and a plurality of spaced lower thread guide holes 6*a*, 6*a*, 6*a*, . . . in the right-hand half portion of the thread guide plate, respectively (as seen in FIG. 1). In the illustrated embodiment, the spool holder base 2 and thread guide plate 5 are mounted on an upright pillar 4 positioned spaced from the rear portion of the sewing machine arm 1. The left-hand portion and the right-hand half portion of each of the spool holder base 2 and of the thread guide plate 5 are associated with the upper thread and the lower thread, respectively.

A second horizontal thread guide plate 7 is supported on the top of the sewing machine arm 1 by means of spaced upright support means 7*a*, 7*a* which extend uprightly from the top of the sewing machine arm 1 in spaced relationship to each other and the thread guide plate 7 is provided with a plurality of spaced thread guide holes 8, 8, 8, . . . The leading ends of the threads from the upper thread spools 3, 3, 3, . . . on the spool holder base 2 are adapted to be guided through the thread guide holes 6, 6, 6, . . . in the thread guide plate 5 and through the thread guide holes 8, 8, 8, . . . in the second thread guide plate 7 to a position above the sewing machine arm 1 whereas the leading ends of the threads from the lower thread spools 3*a*, 3*a*, 3*a*, . . . on the spool holder base 2 are guided through the thread guide holes 6*a*, 6*a*, 6*a*, . . . in the thread guide plate 5 to be allowed to dangle from the guide plate 5.

In FIG. 1, reference numeral 9 generally denotes a thread retaining means which is adapted to prevent the upper thread from a particular spool 3 which is not then used in a sewing operation from getting out of the associated thread guide hole 8 under the action of vibration which will inevitably occur during the sewing operation on the sewing machine. In FIGS. 2A, 2B and 2C, three alternative embodiments of the thread retaining means 9 are shown. In the embodiment as shown in FIG. 2A, the thread retaining means comprises a thread engaging plate member 10 suitably secured to one surface of a lower portion of the second thread guide plate 7 and having a plurality of hook-shaped projections 11, 11, 11, . . . which extend laterally outwardly from the plate member 10 and are spaced vertically. The leading end of the upper thread from a particular spool 3 which is not then used in the sewing operation is temporarily caught between adjacent ones of the projections 11. In the embodiment of the thread retaining means as shown in FIG. 2B, the thread retaining means comprises an elastic sleeve 12 surrounding a lower portion of the second thread guide plate 7 in slightly spaced relationship thereto so that the leading end of the upper thread from the particular spool 3 not used in the sewing operation is inserted into the space between the guide plate and sleeve to be temporarily retained in position. In the embodiment of the thread retaining means as shown in FIG. 2C, the thread retaining means comprises a cover 13 which is pivoted by means of a pin 13*a* to the second thread guide plate 7 adjacent to each of the thread guide holes 8 and the cover 13 is normally held out of the associated guide hole 8. When the thread from a particular upper thread spool 3 is not used in the sewing operation, the cover 13 associated with the guide hole 8 through which the thread from the particular upper thread spool 3 is passed or guided is manually pivoted about its pivot pin 13*a* to close the hole 8 so as to pinch the leading end of the thread between the second upper thread guide plate 7 and the cover 13.

With the above-mentioned construction and arrangement of the components of the spool holding device of the present invention, since the leading ends of the threads from the upper thread spools 3, 3, 3, . . . are positioned on the second thread guide plate 7, in a sewing operation, it is required that the leading end of the thread from one selected upper thread spool 3 is passed or guided through one of the guide holes 8 to the needle on the sewing machine. When a thread replacement is desired, the leading end of the thread from the upper thread spool 3 which is now being used is severed just short of the associated guide hole 8 in the second thread guide plate 7 in the path of the thread extending between the first and second thread guide plates 5, 7 and the leading end of the thread from another selected upper thread spool 3 is then passed or guided through the associated guide holes 6 and 8 in the first and second thread guide plates 5, 7 to the sewing machine needle. The thread replacement operation is simple and does not necessitate the operator to stand up to thereby reduce fatigue on the part of the operator.

It will be understood that when the above-mentioned upper thread replacement is conducted, simultaneously a lower thread replacement should be also performed. Since the leading ends of the threads from the lower thread spools 3*a*, 3*a*, 3*a*, . . . dangle from the respectively associated guide holes 6*a*, 6*a*, 6*a* in the first thread guide plate 5, in the lower thread replacement, the leading end of the thread from a particular lower thread spool 3*a* which is now being used for sewing is wound on a bobbin (not shown). Upon the completion of the winding of the thread from the particular lower thread spool on the bobbin, the lower thread is severed just short of the associated guide hole 6*a* through which the thread is passed or guided and the new leading end of the same lower thread which has been formed by the severance of the thread as mentioned above is allowed to dangle from the associated guide hole 6*a* whereby the lower thread is ready to be used for the sewing operation.

I wish it to be understood that my invention is not to be limited to the specific constructions and arrangements shown and described, except only insofar as the claims may be limited, as it will be understood to those skilled in the art that changes may be made without departing from the principle of the invention.

What is claimed is:

1. A spool holding device for a sewing machine comprising a spool holder base positioned above a rear portion of said sewing machine and supporting a plurality of spaced upper thread spools on one half portion and a plurality of spaced lower thread spools on the other half portion of said spool holder base, respectively, a first thread guide plate positioned above and extending in parallel to said spool holder base, said first thread guide plate being provided in one half portion of the plate with a plurality of spaced upper thread guide holes and in the other half portion of the plate with a plurality of spaced lower thread guide holes, a second thread guide plate supported on the top of the arm of said sewing machine and extending in parallel to said arm, said second thread guide plate being provided with a plurality of upper thread guide holes, and a thread retaining means associated with said second thread guide plate for retaining the thread payed out of one selected upper thread spool in cooperation with the second thread guide plate, whereby the leading end of the threads payed out of the respective upper thread spools are passed through the respectively associated upper thread guide holes in the first and second thread guide plates and positioned above said arm of the sewing machine and the leading ends of the threads payed out of said lower thread spools are passed through the respectively associated lower thread guide holes in said first thread guide plate to dangle from the guide plate.

2. The spool holding device as set forth in claim 1, in which said spool holder base and said first thread guide plate are mounted in vertically spaced relationship on an upright pillar positioned adjacent to said rear portion of the machine.

3. The spool holding device as set forth in claim 1, in which said thread retaining means comprises a thread engaging plate member secured to a lower portion of said second thread guide plate and having a plurality of vertically spaced hook-like projections extending laterally outwardly from said engaging plate member.

4. The spool holding device as set forth in claim 1, in which said thread retaining means comprises an elastic sleeve surrounding a lower portion of said second thread guide plate in spaced relationship to the guide plate.

5. The spool holding device as set forth in claim 1, in which said thread retaining means comprises a cover pivoted to said second thread guide plate adjacent to each of said thread guide holes in the second thread guide plate.

* * * * *